US011724349B2

(12) United States Patent
Eklund

(10) Patent No.: US 11,724,349 B2
(45) Date of Patent: Aug. 15, 2023

(54) TOOL, A TOOL ASSEMBLY AND AN APPARATUS FOR TREATMENT OF THE EDGE OF A KNIFE

(71) Applicant: Tore Eklund, Motala (SE)

(72) Inventor: Tore Eklund, Motala (SE)

( * ) Notice: Subject to any disclaimer, the term of this patent is extended or adjusted under 35 U.S.C. 154(b) by 711 days.

(21) Appl. No.: 16/498,111

(22) PCT Filed: Mar. 20, 2018

(86) PCT No.: PCT/SE2018/050284
§ 371 (c)(1),
(2) Date: Sep. 26, 2019

(87) PCT Pub. No.: WO2018/182483
PCT Pub. Date: Oct. 4, 2018

(65) Prior Publication Data

US 2021/0053171 A1 Feb. 25, 2021

(30) Foreign Application Priority Data

Mar. 27, 2017 (SE) ..... 1700054-8

(51) Int. Cl.
*B24B 3/54* (2006.01)

(52) U.S. Cl.
CPC ..... *B24B 3/54* (2013.01)

(58) Field of Classification Search
CPC ..... B24B 3/54; B24D 15/082; B24D 15/06
USPC ..... 451/552–553
See application file for complete search history.

(56) References Cited

U.S. PATENT DOCUMENTS 1,269,272 A 6/1918 Floback
1,935,592 A * 11/1933 Manfred ..... B24D 15/06 451/554
2,124,646 A * 7/1938 Barsch ..... B24D 15/081 451/163
4,528,777 A 7/1985 Bernstein et al.
4,624,079 A * 11/1986 Bonapace ..... B24D 15/081 76/86
4,731,953 A 3/1988 Owen
(Continued)

FOREIGN PATENT DOCUMENTS

DE 823712 * 7/1949
DE 823712 C 12/1951
(Continued)

OTHER PUBLICATIONS

GB 474100 A, Improvements in Knife Sharpeners. (Year: 1936).*
(Continued)

*Primary Examiner* — Nhat Chieu Q Do
(74) *Attorney, Agent, or Firm* — Moore & Van Allen PLLC; W. Kevin Ransom

(57) ABSTRACT

A tool assembly is arranged for simultaneous treatment of both sides of the edge of a knife. The tool assembly comprises a tool in the form of a stave having faces extending longitudinally between first and second ends of the stave. A holder is provided in which the stave is journaled pivotally within a restricted pivot angle range (α) defined by a pivot limit function accomplished through interaction between the holder and the stave. A pivot journal means, for example, in the form of a pivot pin and a pinhole, is arranged for journaling the stave pivotally about a center axis of the stave.

4 Claims, 5 Drawing Sheets

(56) References Cited

U.S. PATENT DOCUMENTS

| | | | | | |
|---|---|---|---|---|---|
| 4,747,235 | A * | 5/1988 | Priebe | B24D 15/06 | 451/361 |
| 4,903,438 | A * | 2/1990 | Smith | B24D 15/06 | 451/552 |
| 5,440,953 | A | 8/1995 | Gangelhoff et al. | | |
| 9,216,487 | B1 | 12/2015 | Dovel | | |
| 2009/0275272 | A1 * | 11/2009 | Bonapace | B24D 15/082 | 51/293 |
| 2014/0154963 | A1 | 6/2014 | Jhones | | |

FOREIGN PATENT DOCUMENTS

| | | | | | |
|---|---|---|---|---|---|
| DE | 202017005641 | U1 * | 12/2018 | | |
| EP | 3415271 | A1 * | 12/2018 | B24B 3/36 | |
| GB | 2134020 | A | 8/1984 | | |
| JP | 0179560 | U | 5/1989 | | |
| WO | 2016186567 | A1 | 11/2016 | | |
| WO | WO-2016186567 | A1 * | 11/2016 | B24B 3/36 | |

OTHER PUBLICATIONS

Eklund, Tore, European Patent Application No. 18776161.4, Extended European Search Report, dated Nov. 2, 2020.

Eklund, Tore, International Patent Application No. PCT/SE2018/050284, International Preliminary Report on Patentability, dated Oct. 1, 2019.

Eklund, International Application No. PCT/SE2018/050284, International Search Report, dated Apr. 30, 2018.

Eklund, International Application No. PCT/SE2018/050284, Written Opinion, dated Apr. 30, 2018.

* cited by examiner

Fig. 1
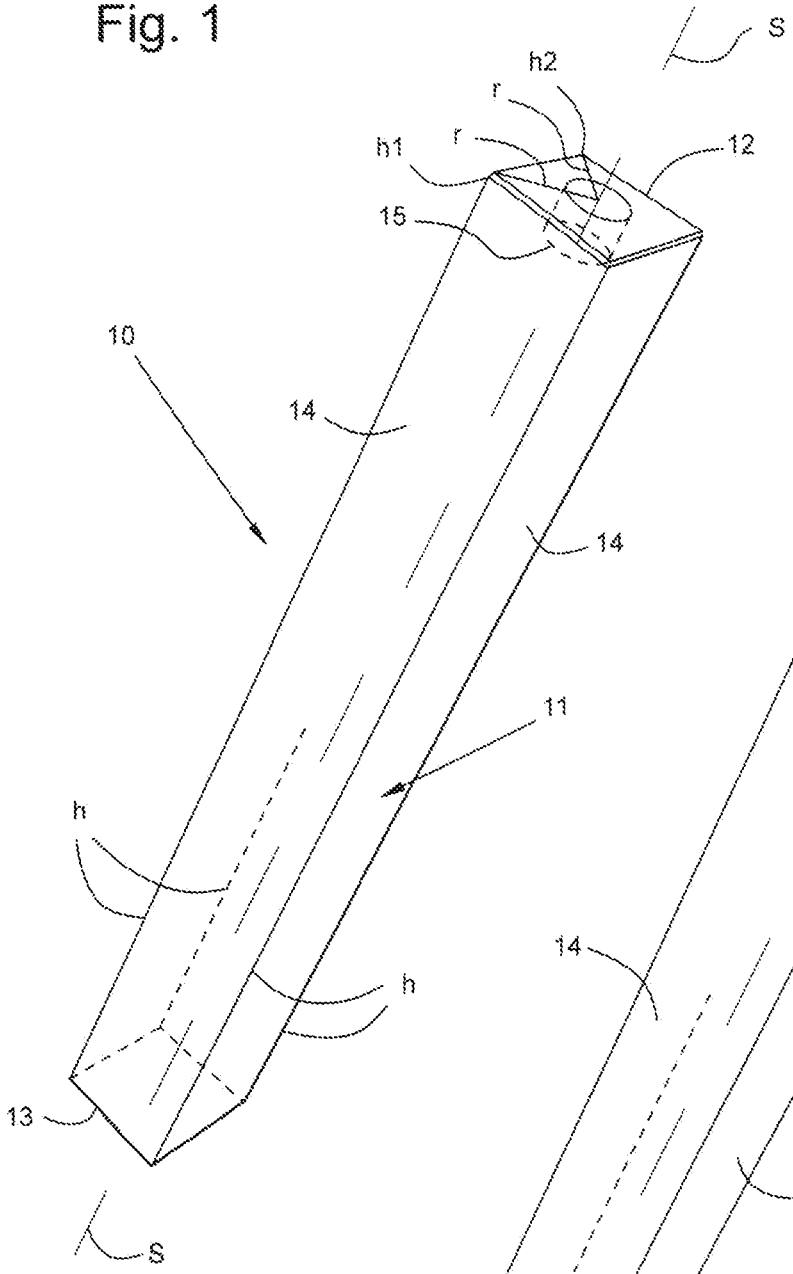
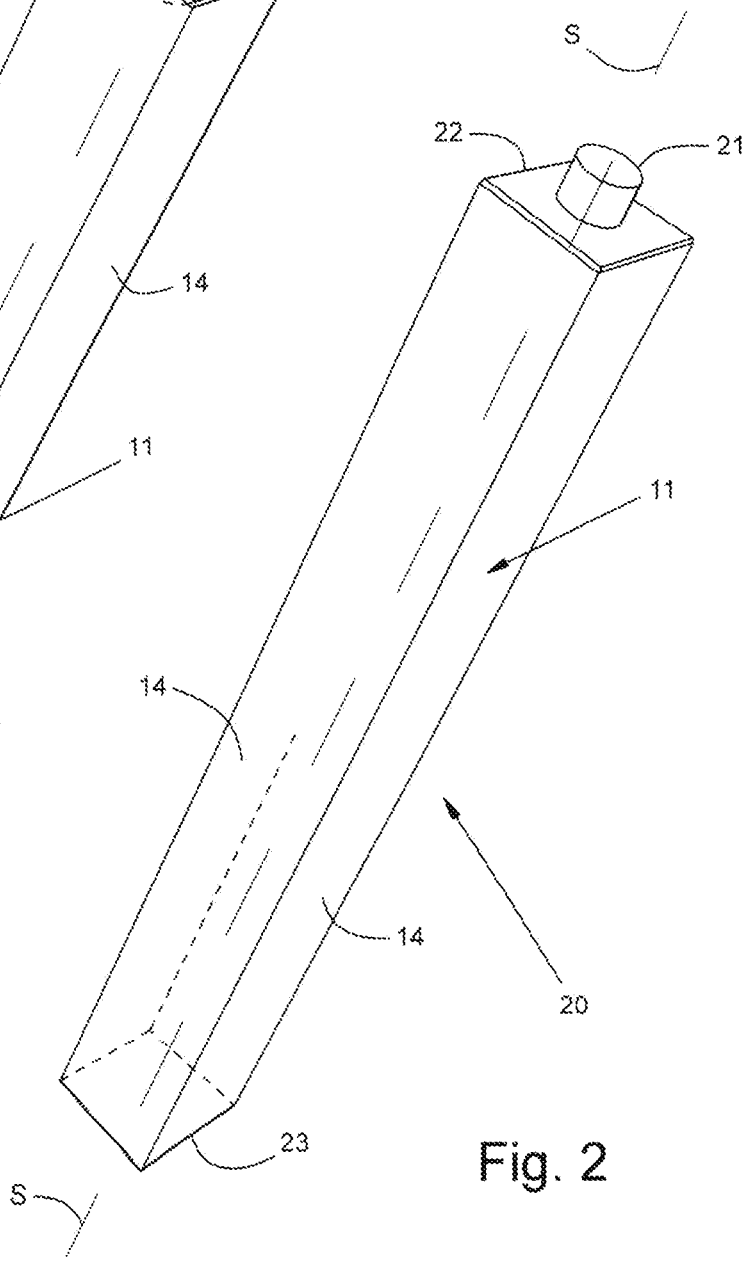
Fig. 2

TOOL, A TOOL ASSEMBLY AND AN APPARATUS FOR TREATMENT OF THE EDGE OF A KNIFE

CROSS-REFERENCE TO RELATED APPLICATION(S)

This application is a national stage application (filed under 35 § U.S.C. 371) of PCT/SE2018/050284, filed Mar. 20, 2018 of the same title, which, in turn, claims priority to Swedish Application No. 1700054-8 filed Mar. 27, 2017; the contents of each of which are hereby incorporated by reference.

FIELD OF THE INVENTION

This invention relates to a tool arranged for treatment of the edge of a knife. Other aspects of the invention relate to a tool assembly comprising the tool pivotally journaled in a holder, as well as to an apparatus in which the tool and tool assembly are installed and effective for simultaneous treatment of both sides the edge of a knife.

BACKGROUND OF THE INVENTION

The invention relates particularly to sharpening apparatuses of the kind which comprise two or more tools that extend crosswise in overlapping relation in order to form between them a V-shaped groove into which a knife blade can be inserted and manually moved forward and backwards in contact with the tools, for simultaneous treatment of both sides of the knife edge in the bottom region of the V-shaped groove.

In this kind of sharpening apparatus, the tools are arranged movable in opposite directions such that depth and width of the V-shaped groove can adjust to the force by which the knife blade is pressed towards the tools during treatment. The tools are typically biased by springs towards each other, whereby the biasing force is balanced to provide, on one hand, a suitable counterforce for treatment of the edge of the knife, and on the other hand sufficient force to return the tools to a neutral position once the knife blade is removed from the V-shaped groove.

Sharpening apparatuses of this kind are previously known, see for example U.S. Pat. No. 4,624,079 A or WO 2016186567 AI.

U.S. Pat. No. 4,624,079A discloses a sharpening apparatus wherein a grinding tool is shaped as a round bar which can be rotated in order to select a portion of its periphery to be used in a grinding process. During the grinding process however, the grinding bar is non-rotationally secured in a holder. WO 2016186567 AI discloses a sharpening apparatus wherein tools are rotationally journaled in holders by means of hinge connections. One advantage of having the tool pivotally journaled in the holder is that the tool will automatically adjust to the orientation of a knife which is not constantly moved in the same straight path during treatment. In WO 2016186567 AI the hinge connection includes a ridge protruding from the rear of the tool, the ridge insertable axially into a groove of corresponding sectional shape formed in the opposite front of the holder.

It should be realized that since the pivot axis is located externally on the rear side of the tool of WO 2016186567 AI, this tool can offer one effective edge treatment surface only, which is the front surface facing opposite from the hinge connection and the holder.

A sharpening tool with several optionally available treatment surfaces is previously known from the German patent DE 823712 C. This document discloses a tool having three effective surfaces offering various treatments of a razor knife. The tool comprises one surface consisting of hard wood, a second surface comprising soft wood, and a third surface comprising a string of leather. In use, the razor knife is moved essentially in longitudinal direction of a treatment surface. The tool is coupled to a handle by which the user holds the tool and manually prevents the tool from rotation during use. The sharpening tool of DE 823712 C is thus not pivoting during use and has neither the objective nor the capacity of solving problems caused by irregular knife movements during double-sided treatment of a knife edge, which is a fundamental functionality in sharpening arrangements of same kind as the present invention.

SUMMARY OF THE INVENTION

An object of the present invention is to provide an arrangement by which irregular movements of a knife during double-sided treatment of the knife edge can be compensated for, while simultaneously providing substantial extension of the service life and utilization of a tool for the treatment of a knife edge. The object is met by the tool, tool assembly and apparatus as disclosed below, all providing extended freedom in design and use of a tool and apparatus for simultaneous treatment of both sides the edge of a knife.

In one aspect of the invention, the objective is met in a tool for treatment of the edge of a knife, the tool shaped as a stave defined by faces extending in longitudinal direction from a first to a second end of the stave, wherein pivot journal means are arranged for journaling the stave pivotally about a pivot axis which passes longitudinally through the stave internally of the faces. Adjacent corners in the sectional profile of the stave are located at a distance from the pivot axis which is adapted for pivot limiting interaction with a holder in use of the tool.

Said axis may be coincident with a center axis of the tool/stave.

In one preferred embodiment the stave has four faces in a rectangular sectional profile.

The stave may have an equilateral cross-sectional geometry, such as in an equilateral triangle or a square.

In one embodiment at least two faces of the stave carry an edge treatment surface respectively.

In one embodiment, edge treatment surfaces are located on diametrically opposite faces of the stave. Any one of the faces is this way optionally available for treatment of a knife to be treated.

The pivot journal means comprises a pivot pin or a pinhole in a pin and pinhole combination.

In one embodiment the pivot journal means comprises a pinhole formed in one or both ends of the stave and arranged for insertion of a pivot pin, respectively, supported in the holder. In an alternative embodiment the pivot journal means comprises a pivot pin formed in one or both ends of the stave arranged for insertion into a pinhole, respectively, formed in the holder. Each embodiment of the pivot journal means can be applied in one or both ends of the stave, and the two embodiments can also be combined in one stave.

In one embodiment, a pivot pin seated in an end of the stave or in the holder is biased by a spring towards engagement with a pinhole formed in the holder or in the end of the stave, respectively.

In one embodiment, the stave is axially arrested by means of a retainer spring that pivo tally engages a recess formed in the outside of the stave.

It is not desired to have the stave rotating freely in the holder, since that might lead to the risk of the stave being brought into an uncontrolled rotation by the knife when the knife is moved back and forth during treatment. For this reason, a pivot limit function is implemented into the tool and effectuated through interaction with a holder in use of the sharpening tool. The user can this way decide which side of the tool is to be used for treatment of the knife edge at each given time.

The pivot limit function is realized in the cross-sectional shape of the stave to prevent the same from rotation through 360° in the holder. More precisely, adjacent corners in the cross-sectional profile of the stave are located at a distance from the pivot axis which is larger than the shortest distance from the pivot axis to the holder in the tool assembly, whereby said corners, or an intermediate face connecting the corners, will hit the holder to be stopped thereby when rotation reaches a limit of the allowed pivot angle range.

The stave preferably has a continuous sectional profile, at least for the effective part of its length. Although preferred, it is however not required that all faces run in parallel with a longitudinal axis of the stave, since the advantages provided by the invention can be utilized also in embodiments wherein one or more faces are somewhat inclined in relation to the longitudinal axis.

The stave can have three or more sides or faces. The faces may be planar or arcuate in convex shape, and one stave may include both planar and arcuate faces.

The staves may be ceramic or made in metal, such as light metal or hard metal comprising an embossed or sandblasted effective surface, or an effective surface achieved through the application of a layer of abrasive or polishing grit. Among the advantageous provided by the invention to be pointed out here is the possibility to equip one singular stave with edge treatment surfaces having different degree of grinding effects, such as coarse grinding, fine grinding, honing, polishing, or straightening of a knife edge. In this context, straightening of the knife edge refers to the process of reshaping the outermost edge of the knife into a more perfect linear extension in the longitudinal direction of the knife.

Obviously, the benefits of the invention are best utilized when the stave is provided two or more edge treatment surfaces which can be individually selected for treatment of the knife edge through any of grinding, honing, polishing or straightening. For example, a ceramic grinding stave may be coated with diamond on at least one of its faces adapted for polishing or honing.

The at least two edge treatment surfaces can be the adjacent faces separated by a corner in the sectional profile, or the opposite faces separated by an intermediate face in a stave of rectangular sectional profile.

In one embodiment, the stave comprises pivot journal means in the form of a pinhole mouthing in an end of the stave, the pinhole dimensioned for journaling the stave on a pivot pin pivo tally about an axis going through the body of the stave, internally of said faces. Said axis may form the center axis of the stave. In one aspect of the invention, the stated object is met in a tool assembly for use in an apparatus arranged for simultaneous treatment of both sides the edge of a knife, the tool assembly comprising a tool in the form of a stave defined by faces extending in longitudinal direction from a first to a second end of the stave, pivot journal means arranged for journaling the stave pivotally about a pivot axis which passes longitudinally through the stave internally of said faces, a holder in which the stave is journaled pivotally within a restricted pivot angle range, wherein adjacent corners in the sectional profile of the stave are located at a distance from the pivot axis which is larger than the shortest distance between the pivot axis and the holder in the tool assembly. Mounting of the stave in the holder can be facilitated by means of a separable holder such that pivot pins and pinholes can be joined for engagement by bringing the parts of the holder together. In one alternative embodiment, mounting is facilitated in that a pivot pin is seated in either of the holder or the stave and biased by a spring, whereby the stave can be displaced axially against the force of said spring so as to bring a pivot pin or pinhole in the other end of the stave into or out from its engaging position. In one embodiment, mounting can be facilitated through a separate pivot pin which can be passed through a hole made in the holder for engagement with a pinhole in the end of the stave.

The tool and tool assembly can be applied in an apparatus of the type in which two or more tools are overlapping each other at intersecting directions in order to form between them a V-shaped groove into which a knife can be inserted and moved manually back and forth while in contact with the tools for simultaneous treatment of both sides of the knife edge. In accordance with the aforesaid, the tools are shaped as staves defined by faces extending in longitudinal direction from a first to a second end of the staves, pivot journal means arranged for journaling the staves pivotally about pivot axes that pass longitudinally through the staves internally of said faces, holders in which the staves are journaled pivotally within restricted pivot angle ranges, wherein adjacent corners in the sectional profile of each stave are located at a distance from the pivot axis which is larger than the shortest distance between the pivot axis and the respective holder. In one embodiment the stave has rectangular section and rises at a slanting angle from a movable holder member through a slot formed in a stationary holder member. A difference in widths between the stave and the slot permits a restricted rotation of the stave about the pivot axis, within the slot.

Further details and advantages of the invention will appear below from the detailed description and from the appended claims.

BRIEF DESCRIPTION OF THE DRAWINGS

Embodiments of the invention will be explained below with reference made to the accompanying schematic drawings, wherein FIG. 1 shows a first embodiment of a tool for treatment of the edge of a knife three-dimensional view, FIG. 2 shows an alternative embodiment of the tool in three-dimensional view.

DETAILED DESCRIPTION OF THE INVENTION

Figure 3:
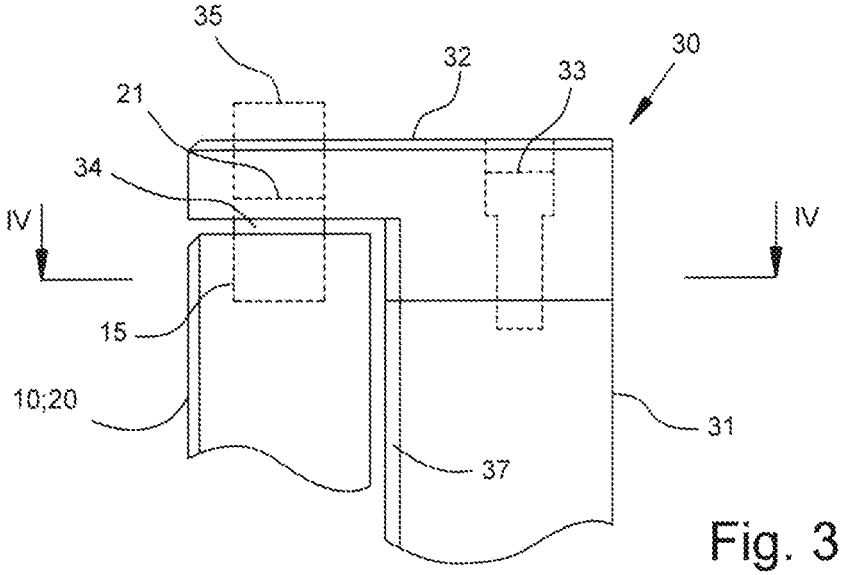
FIG. 3 shows the pivotal journaling of a tool in one end of a tool holder of a first embodiment.

A tool 10 for treatment of the edge of a knife is shown in three-dimensional view in FIG. 1. The tool 10 has an elongate body 11 reaching from a first end 12 to a second end 13. The body 11 is defined by its sides or faces 14 which can be three or more in numbers.

In the embodiments of FIGS. 1 and 2, the body 11 has a four-faced rectangular sectional profile wherein adjacent faces 14 are joined at corners h running in the length of the body 11.

At least one, preferably two or more of the faces 14 has a surface which is effective for treatment of a knife edge. The tool 10 has a length which is larger than the width thereof and may in this respect be seen as a cornered stave. Thus, the stave 10 has a pivot axis S that runs through the body 11 in the length direction of the stave 10, internally of the faces 14. "Internally" of the faces means that a normal through the pivot axis from the most adjacent face of the stave forms the radius of a circle that is fully located within the sectional profile of the stave. Since the pivot axis S is located internally of the faces 14, any one face is optionally available for treatment of the edge of a knife. The pivot axis S may also constitute the center axis of the stave 10. Accordingly, although not mandatory, all corners of the stave may be located on a circle at the same radial distance from the pivot axis S.

A pivot journal means in the form of a pinhole 15 is arranged in at least one end 12 or 13 of the stave 10. From its mouth in the end of the stave, the pinhole extends for a length into the body 11 in concentric relation to the pivot axis S. A corresponding pinhole may be arranged in the opposite end of the stave 10.

Pinholes 15 can be of various lengths. For example, the pinhole 15 may be a blind-hole or extended all through the body 11 so as to mouth in both ends 12 and 13. FIG. 2 shows an alternative embodiment of the tool for treatment of the edge of a knife. Similar to the tool of FIG. 1, the tool 20 of FIG. 2 is a stave with a four-faced rectangular sectional profile. The stave 20 differs from the previous embodiment in that the pivot journal means is arranged in the form of a pivot pin 21 that projects from an end of the stave 20, concentrically about the pivot axis S (wherein the latter also in this embodiment can form the center axis of the stave 20).

Corresponding pivot pins can be formed in one or both ends 22, 23 of the stave 20.

The stave 20 and the pivot pin 21 may be formed in one piece. The pivot pin 21 may alternatively be formed separately and afterwards inserted into the stave 20. A pivot pin 21 and a pinhole 15 may be applied in combination in the same stave. In use, the tool 10 or 20 interacts with a holder to form a tool assembly in a sharpening apparatus configured for simultaneous treatment of both sides of the edge of a knife.

FIG. 3 is a partially broken away elevational view showing a tool and stave 10 or 20 pivotally mounted in a holder 30 of a first embodiment of the tool assembly. The stave 10 or 20 and the holder 30 form a tool assembly for a sharpening apparatus wherein two staves extend mutually overlapping at intersecting directions so as to form between them a V-shaped groove as is known per se, wherein a knife can be inserted and moved manually back and forth while in contact with treatment surfaces on the staves for simultaneous treatment of both sides the edge of a knife. The holder 30 is separable and includes a shaft 31 and a detachably mounted head 32. The holder parts 31, 32 can be joined together by either of a threaded connection 33, a snap-lock engagement, or through a form-fitting engagement between the parts 31 and 32, e.g.

A pivot pin 34 is supported on the holder 30 and in mounted position received in a pinhole 15 in the end of the stave 10. In alternative way, a pivot pin 21 in the end of a stave 20 may be pivotally received in a pinhole formed in the opposite side of the head 32 of the holder, as indicated by dashed lines 21 in FIG. 3. In the drawing, a dashed line 35 indicates a third alternative for journaling the stave 10 in the holder, comprising a separate pivot pin 35 which can be inserted into a pinhole 15 in the end of the stave via a through-hole arranged in the head 32. In this latter embodiment, the head 32 may be permanently mounted or formed integrally with the shaft 31.

Figure 4:
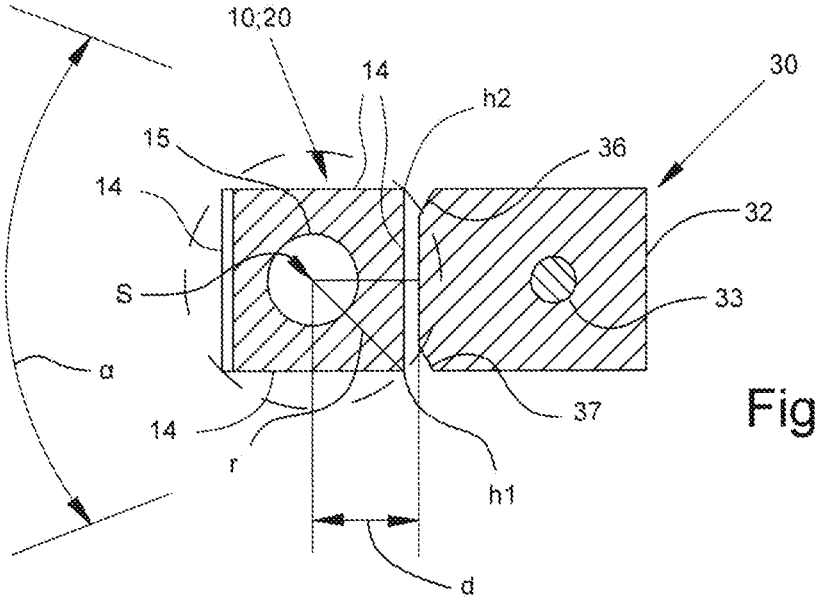
FIG. 4 shows a pivot limit function effective to limit the pivotal movement of the tool in its mounted position in the tool holder of FIG. 3.

FIG. 4 is a cross-sectional view through the arrangement of FIG. 3 taken along the line IV-IV in FIG. 3. FIG. 4 illustrates a pivot limit function which is realized in that adjacent corners h1 and h2 in the cross-sectional profile of the stave 10 or 20 are located at a distance r from the axis S which is longer than the shortest distance d from the axis S to the holder, in a plane transverse to the pivot axis S, such that said corners, or the intermediate face between the corners h1 and h2, will hit the holder to be stopped thereby when rotation reaches a limit for allowed pivoting within a restricted pivot angle range $\alpha$. Chamfering 36, 37 may be applied to corners in that side of the shaft 31 which is facing the stave, to provide precise definition of the restricted pivot angle range $\alpha$.

As already mentioned, all corners of the staves 10 or 20 may be located on the same or substantially the same distance r from the pivot axis S, such that the pivot limit function is provided regardless of which side of a stave that is facing the holder in the mounted position, as long as the condition of $r>d$ is met with.

Figure 5:
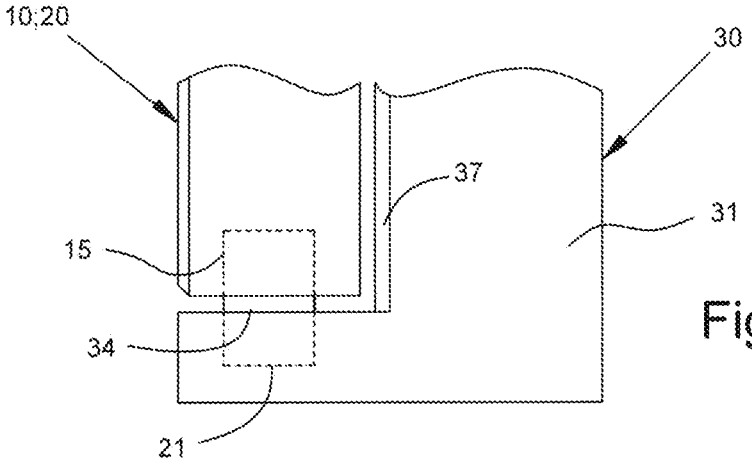
FIG. 5 shows the pivotal journaling of a tool in an opposite end of the tool holder of FIGS. 3 and 4, FIG. 6-8 are partially sectioned views showing alternative embodiments of the tool for treatment of the edge of a knife.

FIG. 5 illustrates journaling of the opposite end of a stave 10 or 20 in a lower part of the holder 30. In a way similar to the upper journal, a pivot pin 34 projects from the holder for engagement with a pinhole 15 mouthing in a lower end of the stave.

Obviously, the holder 30 may alternatively be separable in a lower region of the shaft 31. It will be understood, that also the subject end of the stave may be journaled in the holder by means of a pivot pin 21 which protrudes from a stave 20 for insertion into a pinhole formed in the opposite side of the holder, as explained with reference to FIG. 3. The expressions upper and lower as used herein shall be understood as referring merely to the orientation of the subject elements in the drawings.

Figure 6:
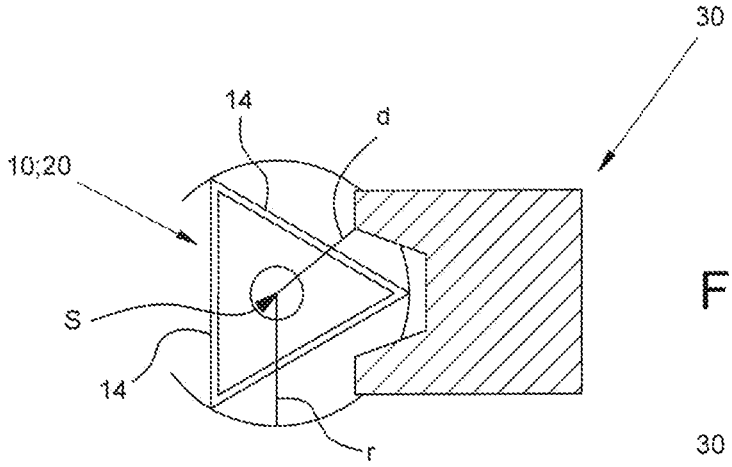
Figure 7:
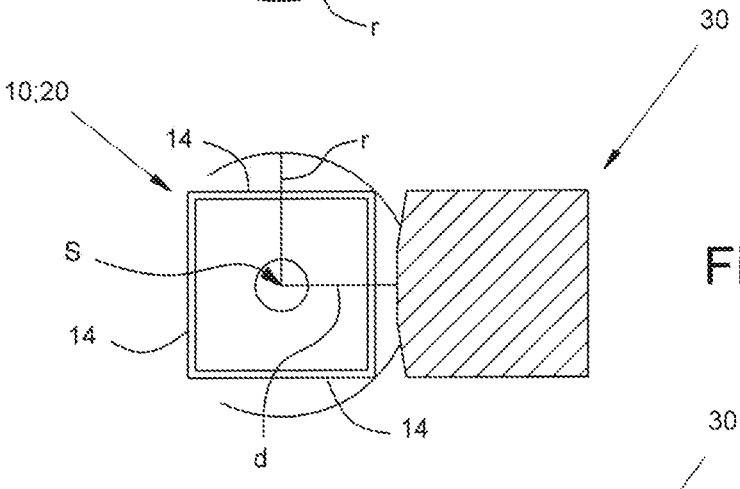
Figure 8:
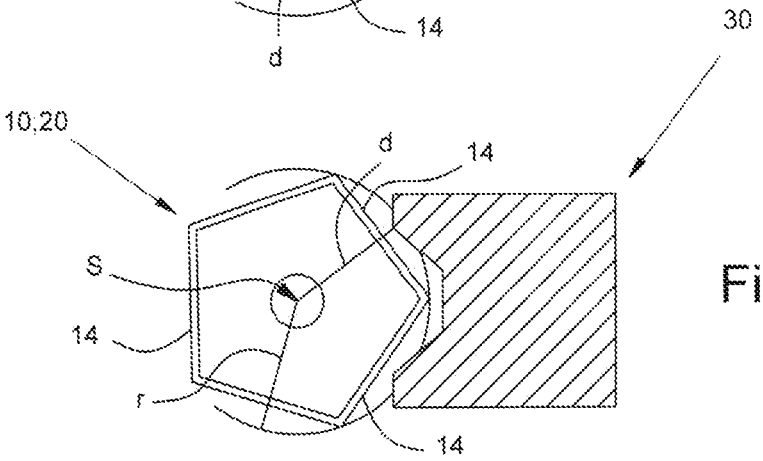

As illustrated in FIGS. 6-8, the staves can have different sectional profiles having different numbers of corners and faces. For example, FIG. 6 shows a tool in the form of a stave having three faces and a triangular cross section. FIG. 7 shows a stave having four faces and a rectangular or square cross section, whereas FIG. 8 shows a stave having five faces and the cross-sectional shape of a pentagon. One singular stave can this way offer up to three, four or five surfaces effective for treatment of a knife edge.

Accordingly, the tools 10, 20 are shaped as multi-faced staves which can be rotated upon journaling in the holder for proper selection of a face for treatment of a knife to be treated within the restricted pivot angle range.

Although the staves shown in FIGS. 6-8 all have equilateral sectional shapes, this is not a requirement for providing the pivot limiting function or other advantages of the invention. Any triangular, rectangular and polygonal shape which meets the condition of r>d can be contemplated for implementation in the tool assembly.

The four-faced embodiment with a rectangular section provides however a preferred combination of strength and utility, especially in ceramic tools. More precisely, the pointed corners of a triangular section would be more brittle and run higher risk of being damaged than the blunt corners of a rectangular section. On the other hand, the transversal width of faces and thus the effective treatment length of each face will be less in a five-faced embodiment than in the four-faced embodiment. The four-faced embodiment thus provides an advantageous combination of versatility, long service life/wear, and durability.

FIGS. 6, 7 and 8 are also examples of tool assemblies wherein different embodiments of the stave-shaped tool may be included in combination with various designs of the holder.

Figure 9:
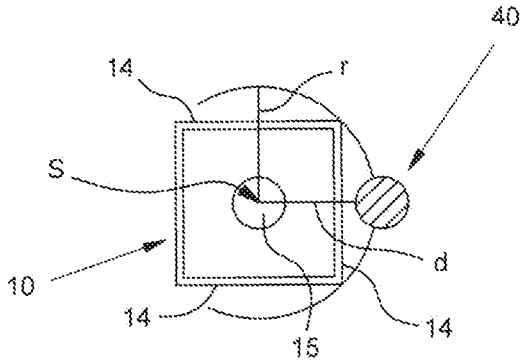
FIGS. 9-10 show the pivotal journaling of a tool in a tool holder of a second embodiment.
Figure 10:
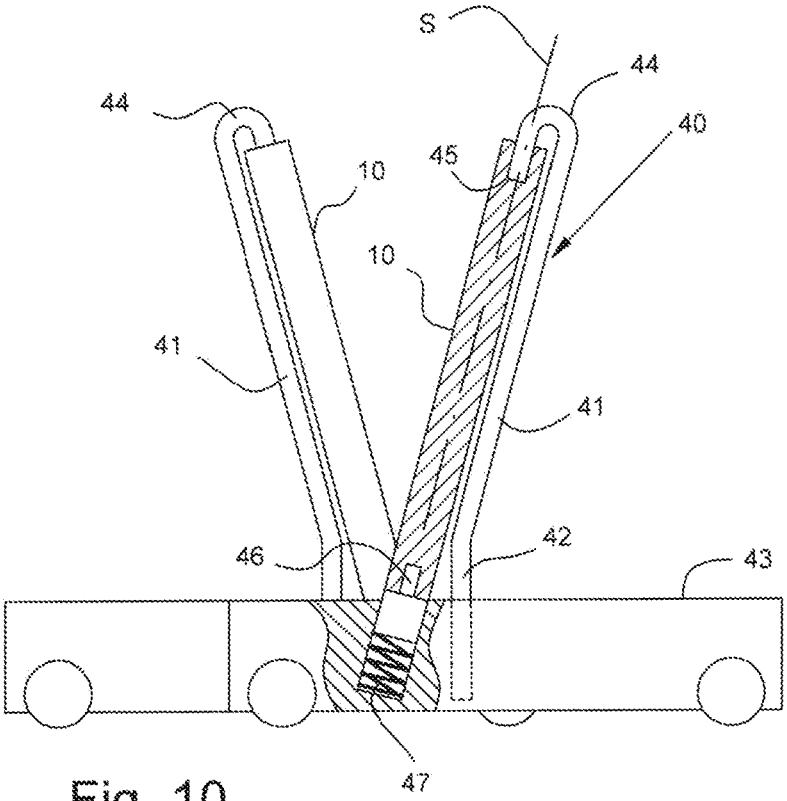

In FIGS. 9 and 10 a tool and stave 10 of rectangular sectional profile is shown in combination with an alternatively designed holder 40. The holder 40 is produced from a rod of circular section, the diameter of which is adapted to the diameter of a pinhole 15 in the end of the stave 10. The holder 40 can be formed from a straight bar which is in one end bent through 180° so as to form a pivot pin for insertion into the pinhole 15. In FIG. 9, the radius r and distance d demonstrate that the above said pivot limit function is implemented also in this embodiment of the tool assembly.

FIG. 10 shows the mounting and journaling of the stave 10 in the holder 40. The holder 40 comprises a shaft 41 which by a first end 42 is secured in a slide or trolley 43 which can be movably arranged in a chassis (not shown) of a sharpening apparatus. The holder shaft 41 reaches upwards at slanting angle to a headend 44, the latter carrying a pivot pin 45 which engages a pinhole formed in an upper end of the stave 10. The opposite end of the stave comprises a second pinhole into which is inserted a pivot pin 46 that is biased from a spring 47, seated in the slide or trolley 43. The pivot pin 46 is this way biased in the direction of the pivot pin 45 at the headend of the holder, and with a biasing force sufficient to lift the stave 10 for journaling on the pivot pins 45 and 46.

Alternatively, a spring biased pivot pin may instead be seated in an end of the stave, if appropriate.

The holder 40 can form part of a tool assembly in a sharpening apparatus in which, in a way known per se, two or more tools are overlapping each other at intersecting directions in order to form between them a V-shaped groove into which a knife can be inserted to be moved manually back and forth while in contact with the effective surfaces of the tools for simultaneous treatment of both sides the edge of the knife.

Figure 11:
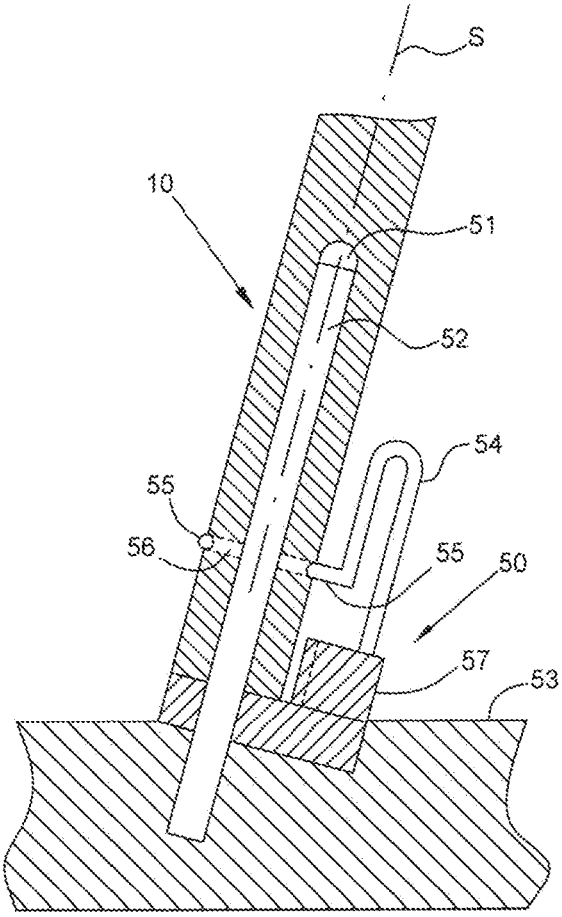
FIG. 11 shows an alternative one-end journaling of the tool on a singular pivot pin.
Figure 12:
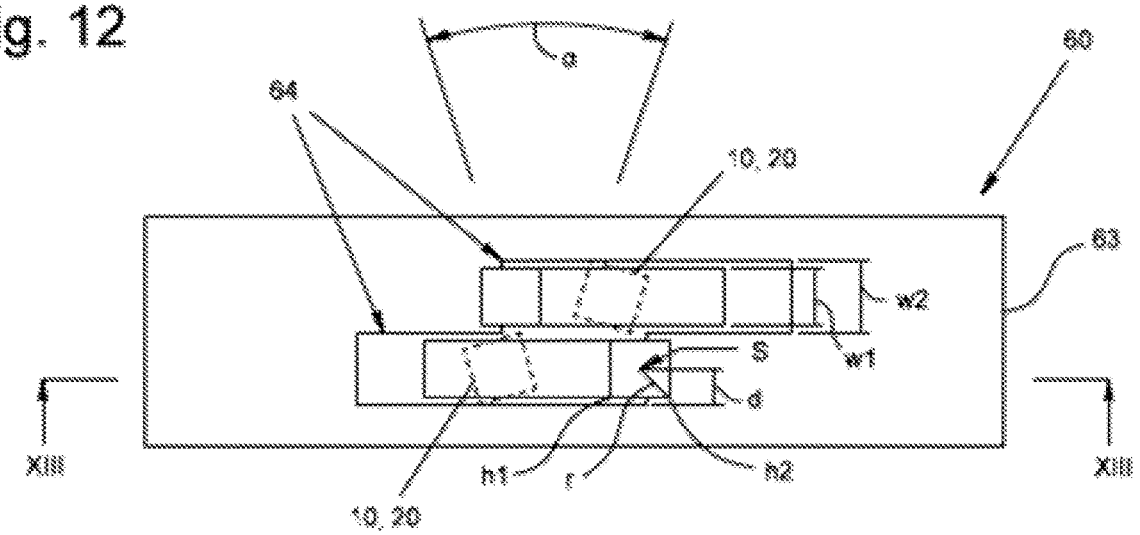
FIG. 12 is a top view of the tool assembly shown in FIG. 13.
Figure 13:
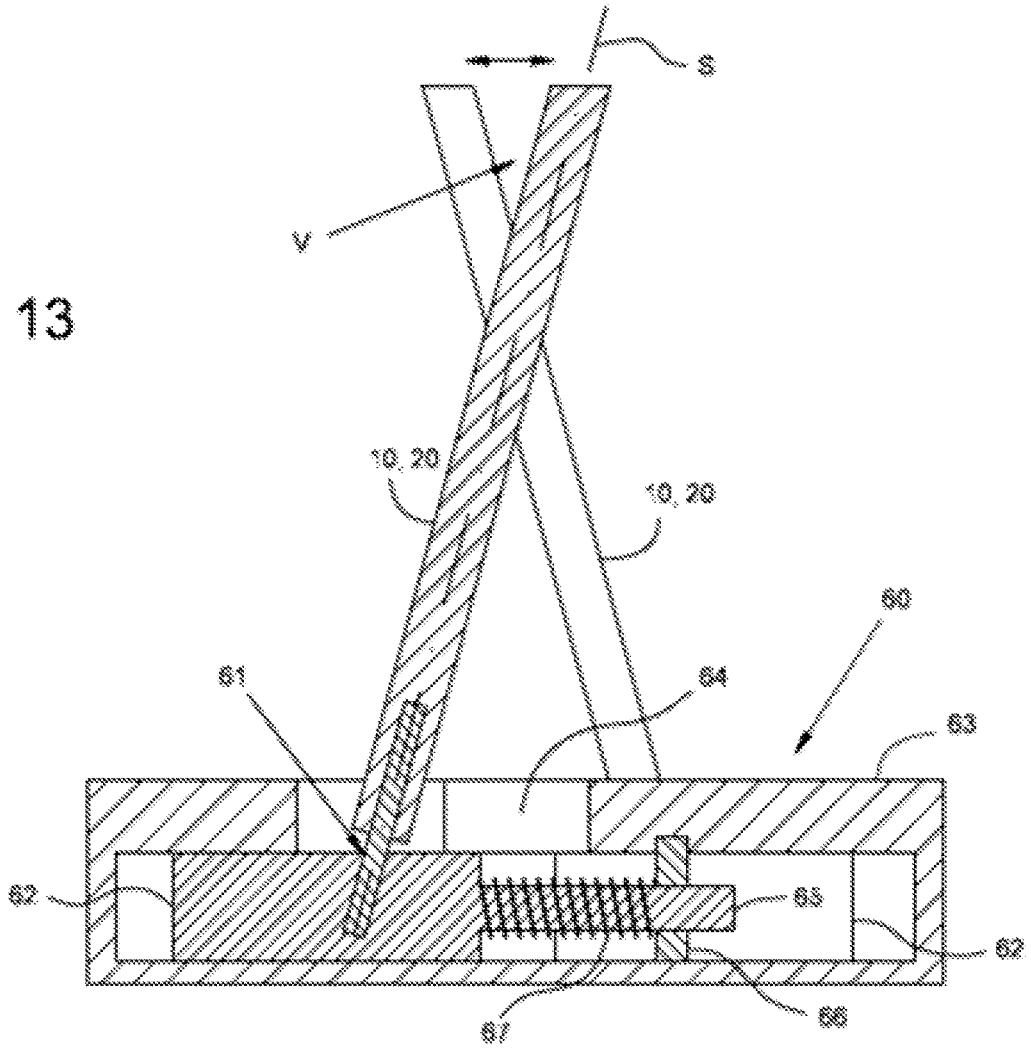
FIG. 13 shows the tool assembly of FIG. 12 in a sectional view taken along line XII-XII in FIG. 12.

In the previous embodiments the tool is journaled in both of its ends. FIG. 11 illustrates a tool that is journaled in a holder 50 by one of its ends only. A stave 10 has a pinhole 51 mouthing in the lower end of the stave. The pinhole is inserted on a pivot pin 52 which reaches from an anchoring point in a holder member 53. In the inserted position, the stave is secured axially by means of a retainer spring 54 including a finger 55. In retaining mode, the finger 55 is slidingly hooked into a recess 56 formed in the outside of the stave. The finger 55 may be bent into arcuate or semi-circular shape, whereas the recess 56 may form a circular or semi-circular groove that reaches circumferentially, at least partially, around the stave 10. The finger 55 may have a length which corresponds to about half the circumference of the stave in order to facilitate a lateral insertion of the finger into the groove upon mounting. In a way similar to what has been disclosed above, a pivot limit function is provided through the interaction between corners or an intermediate face of the stave and a portion 57 of the holder, which reaches a distance upwards along the stave. Another embodiment is illustrated in FIGS. 12 and 13. With reference thereto, a tool and stave 10 or 20 is pivo tally journaled in a holder 60 by means of a pin and pinhole combination, here generally defined as reference number 61. More precisely, the stave is mounted in a moving holder member 62 which can slide back and forth in a stationary holder member 63. In mounted state the stave rises cantilevered from the moving holder member 62, at a slanting angle, through a slot 64 formed in the top of the stationary holder member 63. A rod 65 projects from an end of the movable holder member 62, the rod 65 reaching through a hole formed in a journaling element 66. The rod 65 carries a spring 67 which acts against the journaling element 66 to urge the movable holder member and stave towards an initial position, substantially as shown in the drawings. In side-by-side relation, a corresponding assembly is turned 180° to form, by the crosswise related staves, a groove V into which a knife blade can be inserted for treatment. Downwards pressure from the knife blade causes the staves and movable holder members 62 to move against the force of the respective springs 67, as indicated by the double-arrow in FIG. 13.

A pivot limit function is accomplished by interaction between the holder 60 and the stave 10 or 20. More precisely, in the embodiment of FIGS. 12-13 the stave has a four-faced, rectangular sectional profile having a width w1 that is slightly less than the width w2 of the slot 64 in the top of the holder 60. The allowed pivot angle movement a is defined by the extreme positions at which either of the stave corners h1 or h2, in rotation about the axis S, hits the nearest wall of the slot 64 (as illustrated in dashed lines in FIG. 12). As in previous embodiments, accordingly, the corners h1, h2 are located at a distance r from the pivot axis S which is greater than the shortest distance d between the pivot axis S and the holder 60 in sectional view.

In FIG. 12, the double-arrow a illustrates the pivot angle range a within which the staves can pivot about their axes S. The double-arrow a thus also indicates the amount to which a knife to be treated can deviate from an ideal straight path in the V-groove without losing area of contact with the treatment surfaces of the staves. Since the staves are journaled in their ends, pivotally about the pivot axes S passing through the staves internally of the faces of the staves, any one of the faces 14 is optionally available for treating a knife to be treated within the restricted pivot angle range α.

The elemental geometrical shape of the tool or stave 10, 20, which is void of indications of fracture or other weaknesses, improves the resistance to failure in ceramic staves and sharpening tools made of other material. The non-complex shape of the stave facilitates a simple and efficient cleaning without any risk of dirt or particles that might accumulate in hard-to-access spots.

The invention claimed is:

1. An apparatus comprising at least two tools for treatment of an edge of a knife, wherein the at least two tools overlap each other at intersecting directions in order to form between the at least two tools a V-shaped groove into which a knife can be inserted and moved manually back and forth while in contact with the at least two tools for simultaneous treatment of both sides the edge of the knife, wherein the at least two tools are shaped as staves, wherein each stave comprises a body of rectangular cross-sectional profile comprising four faces extending in a longitudinal direction from a first end to a second end of the stave, wherein faces of the stave that are adjacent to each other are joined at corners running in the longitudinal direction of the stave, the stave having a longitudinal center axis;

wherein each stave is arranged to extend cantilevered in crosswise relation to the other stave from a respective movable holder member extending from a respective slot formed in a top surface of a base holder member in which the respective movable holder member can move back and forth in side-by-side relation relative to the movable holder member of the other stave against a force of a spring which urges the respective movable holder member and stave towards an initial position;

pivot means associated with each stave and respective movable holder member, said means comprising a pivot pin and a pinhole arranged, one in the stave and the other of said pivot pin or pinhole in the movable holder member, respectively, to permit rotation of the stave in the respective movable holder member about the center axis of the stave;

wherein rotation of each stave about its center axis is limited between positions at which any corner of the stave hits a wall of said slot of said base holder member from which the stave and its respective movable holder member extends.

2. The apparatus of claim 1, wherein at least one of the staves comprises an equilateral cross-sectional geometry.

3. The apparatus of claim 1, wherein at least two faces of at least one of the staves carry an edge treatment surface respectively.

4. The apparatus of claim 1, wherein at least one of the staves comprises edge treatment surfaces located on opposite faces of the stave.

* * * * *